US010378342B2

(12) United States Patent
Barak

(10) Patent No.: US 10,378,342 B2
(45) Date of Patent: Aug. 13, 2019

(54) MUD PULSE TELEMETRY USING GRAY CODING

(71) Applicant: HALLIBURTON ENERGY SERVICES, INC., Houston, TX (US)

(72) Inventor: Ehud Barak, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 3 days.

(21) Appl. No.: 15/517,652

(22) PCT Filed: Dec. 29, 2014

(86) PCT No.: PCT/US2014/072539

§ 371 (c)(1),
(2) Date: Apr. 7, 2017

(87) PCT Pub. No.: WO2016/108820

PCT Pub. Date: Jul. 7, 2016

(65) Prior Publication Data

US 2017/0306755 A1 Oct. 26, 2017

(51) Int. Cl.
*E21B 47/18* (2012.01)
*E21B 34/06* (2006.01)

(52) U.S. Cl.
CPC ..... *E21B 47/18* (2013.01); *E21B 34/06* (2013.01)

(58) Field of Classification Search
CPC ..... E21B 34/06; E21B 47/12; E21B 47/14; E21B 47/18; E21B 47/182; E21B 47/185; E21B 47/187
See application file for complete search history.

(56) References Cited

U.S. PATENT DOCUMENTS 3,652,986 A * 3/1972 Monroe ..... H04L 1/0059 714/789
4,078,232 A 3/1978 Balkanli et al.
4,225,855 A * 9/1980 Feldmann ..... H03M 1/60 327/47
4,724,434 A 2/1988 Titchener et al.
4,787,093 A 11/1988 Rorden
4,821,035 A 4/1989 Titchener et al.
4,908,804 A 3/1990 Rorden
(Continued)

FOREIGN PATENT DOCUMENTS

EP 2728746 5/2014
KR 101038239 6/2011
(Continued)

OTHER PUBLICATIONS

"Weighted Code Approach to Generate Gray Code". May 6, 2015, IEEE, IEEE Potentials ( Volume: 34, Issue: 3, May-Jun. 2015 ), pp. 39-40.*

(Continued)

*Primary Examiner* — James J Yang
(74) *Attorney, Agent, or Firm* — Kilpatrick Townsend and Stockton LLP

(57) ABSTRACT

A system can include a well tool operable to transmit a fluid through an interior of the well tool. The system can also include a transmitter coupled to the well tool. The transmitter can select a parameter of a pressure waveform using a Gray code that corresponds to the parameter and generate the pressure waveform in the fluid.

24 Claims, 4 Drawing Sheets

(56) References Cited

U.S. PATENT DOCUMENTS

| | | | | |
|---|---|---|---|---|
| 5,067,114 | A | 11/1991 | Rorden | |
| 5,255,269 | A * | 10/1993 | Stem, Jr. | H04L 27/10 370/537 |
| 5,666,379 | A | 9/1997 | Ovard et al. | |
| 6,201,652 | B1 * | 3/2001 | Rezzi | G11B 5/59616 360/40 |
| 6,421,298 | B1 | 7/2002 | Beattie et al. | |
| 6,700,931 | B1 | 3/2004 | Lee et al. | |
| 6,788,219 | B2 | 9/2004 | Sun et al. | |
| 6,819,512 | B2 | 11/2004 | Kirby | |
| 7,016,403 | B2 | 3/2006 | Hirt et al. | |
| 7,289,560 | B2 | 10/2007 | Huat | |
| 7,349,471 | B2 | 3/2008 | Cosand et al. | |
| 7,480,207 | B2 * | 1/2009 | Marsh | E21B 47/182 367/83 |
| 7,573,397 | B2 * | 8/2009 | Petrovic | G01V 11/002 340/854.6 |
| 8,302,685 | B2 * | 11/2012 | Reyes | E21B 47/182 166/250.01 |
| 8,350,715 | B2 * | 1/2013 | Shearer | E21B 47/18 340/853.1 |
| 8,488,714 | B2 | 7/2013 | Wu et al. | |
| 8,570,833 | B2 * | 10/2013 | Sugiura | E21B 47/185 367/83 |
| 8,588,616 | B2 | 11/2013 | Langer et al. | |
| 8,654,832 | B1 | 2/2014 | Hansen et al. | |
| 8,666,259 | B2 | 3/2014 | Lim et al. | |
| 8,880,349 | B2 * | 11/2014 | Pillai | E21B 47/18 702/9 |
| 9,574,441 | B2 * | 2/2017 | Liu | H04B 11/00 |
| 2003/0016164 | A1 * | 1/2003 | Finke | E21B 47/185 342/83 |
| 2004/0100393 | A1 | 5/2004 | Sun et al. | |
| 2012/0045221 | A1 | 2/2012 | Walewski | |
| 2013/0106615 | A1 | 5/2013 | Prammer | |
| 2014/0072063 | A1 | 3/2014 | Hansen et al. | |

FOREIGN PATENT DOCUMENTS

| | | |
|---|---|---|
| WO | 9938032 | 7/1999 |
| WO | 0205504 | 1/2002 |
| WO | 2011082860 | 7/2011 |

OTHER PUBLICATIONS

International Patent Application No. PCT/US2014/072539, International Search Report and Written Opinion, dated Sep. 21, 2015, 16 pages.

* cited by examiner

| 402 WAVEFORM USING DPPM AND PWM | 404 GRAY CODING VALUE | 406 NUMERICAL VALUE |
|---|---|---|
| 1110 | 0000 | 0 |
| 01110 | 0001 | 1 |
| 11110 | 0011 | 2 |
| 001110 | 0010 | 3 |
| 011110 | 0110 | 4 |
| 111110 | 0111 | 5 |
| 0001110 | 0101 | 6 |
| 0011110 | 0100 | 7 |
| 0111110 | 1100 | 8 |
| 1111110 | 1101 | 9 |
| 00011110 | 1111 | 10 |
| 00111110 | 1110 | 11 |
| 01111110 | 1010 | 12 |
| 000111110 | 1011 | 13 |
| 001111110 | 1001 | 14 |
| 0001111110 | 1000 | 15 |

FIG. 4

MUD PULSE TELEMETRY USING GRAY CODING

CROSS-REFERENCE TO RELATED APPLICATIONS

This is a U.S. national phase under 35 U.S.C. 371 of International Patent Application No. PCT/US2014/072539, titled "Mud Pulse Telemetry Using Gray Coding" and filed Dec. 29, 2014, the entirety of which is incorporated herein by reference.

TECHNICAL FIELD

The present disclosure relates generally to devices for use in well systems. More specifically, but not by way of limitation, this disclosure relates to mud pulse telemetry using Gray coding.

BACKGROUND

A well system (e.g., an oil or gas well for extracting fluid or gas from a subterranean formation) can include a drilling assembly for drilling a wellbore. It can be desirable to collect data about the drilling assembly or the subterranean formation contemporaneously with drilling. This can allow the well operator to steer or otherwise optimize performance of the drilling assembly. Collecting data about the drilling assembly or the subterranean formation while drilling can be known as measuring while drilling (MWD) or logging while drilling (LWD).

MWD or LWD systems can employ mud pulse telemetry to transmit the data to the surface of the well system. Mud pulse telemetry can use a drilling fluid (e.g., mud) within the drilling assembly as a communication medium. One form of mud pulse telemetry can be positive pulse telemetry, in which a valve can restrict the flow of the drilling fluid through the drilling assembly. This can create a pressure pulse. Another form of mud pulse telemetry can be negative pulse telemetry, in which a valve releases drilling fluid from within the drilling assembly into an annular space in the wellbore. This can also create a pressure pulse. Using either of the above forms of mud pulse telemetry, the pressure pulse can propagate through the drilling fluid at the speed of sound, where it can be detected at the surface of the well system. In this manner, the MWD or LWD system can transmit data encoded in pressure pulses to the surface of the well system.

BRIEF DESCRIPTION OF THE DRAWINGS

FIG. 4 is a table showing transmission waveforms associated with Gray codes when $T_{pulse}$=3 ms, $T_q$=1 ms, J=2 bits, and K=2 bits according to one example.

DETAILED DESCRIPTION

Figure 1:
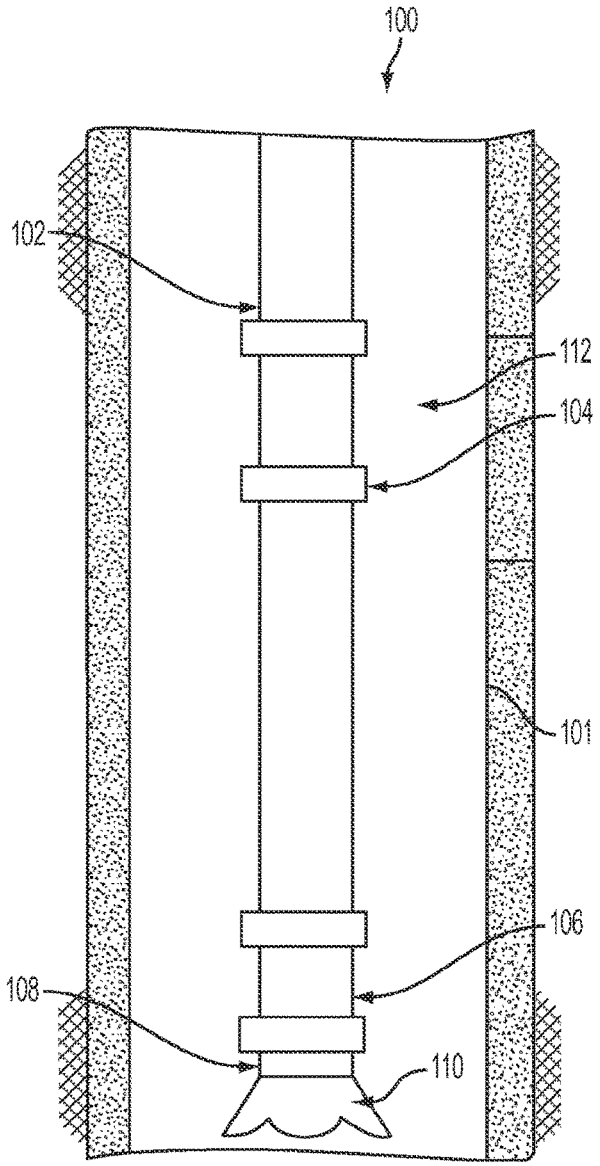
FIG. 1 depicts a well system for implementing mud pulse telemetry using Gray coding according to one example.

Certain aspects and features of the present disclosure are directed to mud pulse telemetry using Gray coding. Gray coding can include mapping two similar transmission waveforms to binary numbers that differ by only one bit. As applied to mud pulse telemetry, two transmission waveforms can be similar if their pressure pulses last for a similar period of time. Two transmission waveforms can also be similar if their total time periods (e.g., the pressure pulse time period and a time period before or after the pressure pulse with low pressure) are similar.

For example, one transmission can have a pressure pulse for 2 milliseconds (ms) followed by 5 ms of low pressure, for a total time period of 7 ms. Another transmission can have a pressure pulse that lasts for 3 ms followed by 4 ms of low pressure, for a total time period of 7 ms. These two transmissions can be similar because they both pressure pulses that last for a similar amount of time and have total time periods of 7 ms. To implement Gray coding, these two transmissions can be mapped to binary values that differ by 1 bit. For example, one transmission can be mapped to the binary number 0000, and the other transmission can be mapped to the binary number 0001. The binary number 0000 differs from the binary number 0001 by only one bit.

In some examples, Gray coding can be used in combination with differential pulse position modulation (DPPM), pulse width modulation (PWM), or both DPPM and PWM. Differential pulse position modulation (DPPM) can be used to encode data in the time period between pressure pulses. PWM can be used to encode data in the width of the pressure pulse. Using Gray coding in combination with DPPM, PWM, or both DPPM and PWM can improve data throughput (e.g., the number of bits per transmission) while reducing errors in the pressure pulse transmissions.

For example, pressure reflections and noise (e.g., pump noise and noise from drill bit rotation) can distort the shape of the pressure pulse received at the surface of the well system. In one example, noise can cause the width of the pressure pulse received at the surface of the well system to be different than the width of the pressure pulse output by the transmitter. This can cause one transmission to be mistaken for another transmission with a similar pressure pulse width, generating error. If one transmission is distorted into a similar transmission's waveform, using Gray coding, there is only 1 bit of error. This can reduce the overall raw bit error rate for the mud pulse telemetry system. By combining PPM, PWM, and Gray coding, the transmitter can transmit more data (e.g., there can be a higher data rate) with more reliability (e.g., due to a reduced raw bit error rate).

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 depicts a well system 100 for implementing mud pulse telemetry using Gray coding according to one example. In this example, the well system 100 includes a wellbore 101. A well tool 102 (e.g., a drill string) can be positioned in the wellbore 101. In some examples, the well tool 102 can include a logging while drilling (LWD) tool or a measuring while drilling (MWD) tool.

The well tool 102 can include various tubular sections and subsystems. For example, the well tool 102 can include sensors 108 for determining information about the wellbore 101, the subterranean formation, and the well tool 102 (e.g., drilling parameters). The well tool 102 can also include a transmitter 106 for transmitting data (e.g., from the sensors 108) to the surface of the well system 100. The well tool 102 can further include a drill bit 110 for drilling the wellbore 101. In some examples, the tubular sections and subsystems can be coupled by tubular joints 104.

Fluid (e.g., mud) can be pumped through the well tool 102 at high pressure. The fluid can flow through ports or jets in the drill bit 110. The fluid can travel through a space 112 (e.g., an annulus) between the well tool 102 and a wall of the wellbore 101 to the surface of the well system 100. In some examples, at the surface of the well system 100, the fluid can be cleaned and recirculated through the well tool 102.

The transmitter 106 can include a valve. The transmitter 106 can open and close the valve to modulate the pressure of the fluid in the well tool 102. This can generate pressure pulses that can propagate through the fluid to the surface of the well system 100. One or more pressure transducers (not shown) at the surface of the well system 100 can convert the pressure pulses into electrical signals. The transducers can transmit the electrical signals to a computing device. The computing device can analyze the electrical signals to determine data associated with the pressure pulses. In this manner, the transmitter 106 can communicate with a computing device at the surface of the well system 100.

Figure 2:
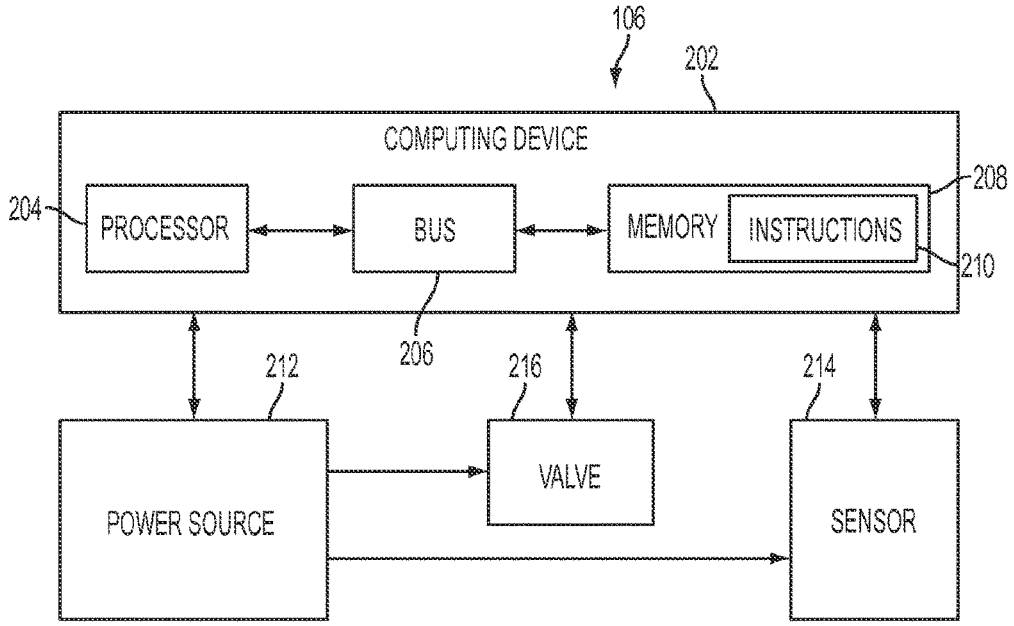
FIG. 2 is a block diagram of a transmitter for implementing mud pulse telemetry using Gray coding according to one example.

FIG. 2 is a block diagram of a transmitter 106 for implementing mud pulse telemetry using Gray coding according to one example. In some examples, the components shown in FIG. 2 (e.g., the computing device 202, power source 212, and valve 216) can be integrated into a single structure. For example, the components can be within a single housing. In other examples, the components shown in FIG. 2 can be distributed (e.g., in separate housings) and in electrical communication with each other.

The transmitter 106 can include a computing device 202. The computing device 202 can include a processor 204, a memory 208, and a bus 206. The processor 204 can execute one or more operations for engaging in mud pulse telemetry using Gray coding. The processor 204 can execute instructions 210 stored in the memory 208 to perform the operations. The processor 204 can include one processing device or multiple processing devices. Non-limiting examples of the processor 204 include a Field-Programmable Gate Array ("FPGA"), an application-specific integrated circuit ("ASIC"), a microprocessor, etc.

The processor 204 can be communicatively coupled to the memory 208 via the bus 206. The non-volatile memory 208 may include any type of memory device that retains stored information when powered off. Non-limiting examples of the memory 208 include electrically erasable and programmable read-only memory ("EEPROM"), flash memory, or any other type of non-volatile memory. In some examples, at least some of the memory 208 can include a medium from which the processor 204 can read the instructions 210. A computer-readable medium can include electronic, optical, magnetic, or other storage devices capable of providing the processor 204 with computer-readable instructions or other program code. Non-limiting examples of a computer-readable medium include (but are not limited to) magnetic disk(s), memory chip(s), ROM, random-access memory ("RAM"), an ASIC, a configured processor, optical storage, or any other medium from which a computer processor can read instructions. The instructions may include processor-specific instructions generated by a compiler or an interpreter from code written in any suitable computer-programming language, including, for example, C, C++, C#, etc.

The transmitter 106 can include one or more sensors 214. The sensors 214 can detect characteristics associated with a well tool (e.g., a drill string) and/or the subterranean formation. The sensors 214 can transmit sensor signals associated with the characteristics to the computing device 202.

The transmitter 106 can include a power source 212. The power source 212 can be in electrical communication with the computing device 202, the sensors 214, and a valve 216. The power source 212 can power the transmitter 106, sensors 214, and valve 216. In some examples, the power source 212 can include a battery. In other examples, the power source 212 can include a power cable (e.g., a wireline).

The transmitter 106 can include the valve 216. The computing device 202 can operate (e.g., open and close) the valve 216 to generate and transmit pressure pulses associated with data. For example, the computing device 202 can directly operate the valve 216, or the computing device 202 can cause power source 212 to operate the valve 216. In some examples, the data can be associated with sensor signals from the sensors 214. For example, the computing device 202 can receive sensor signals from the sensors 214. The computing device 202 can analyze the sensor signals and, based on the sensor signals, operate the valve 216 to transmit data associated with the sensor signals (e.g., to the surface of a well system).

In some examples, the valve 216 can include a completely opened state, in which fluid can flow through the valve 216. The valve 216 can also include a completely closed, in which fluid cannot flow through the valve 216. In other examples, the valve 216 can partially open in varying amounts. This can allow the valve 216 to generate varying amounts of pressure (e.g., to generate pressure pulses with varying amplitudes) in the fluid flowing through the valve 216.

Figure 3:
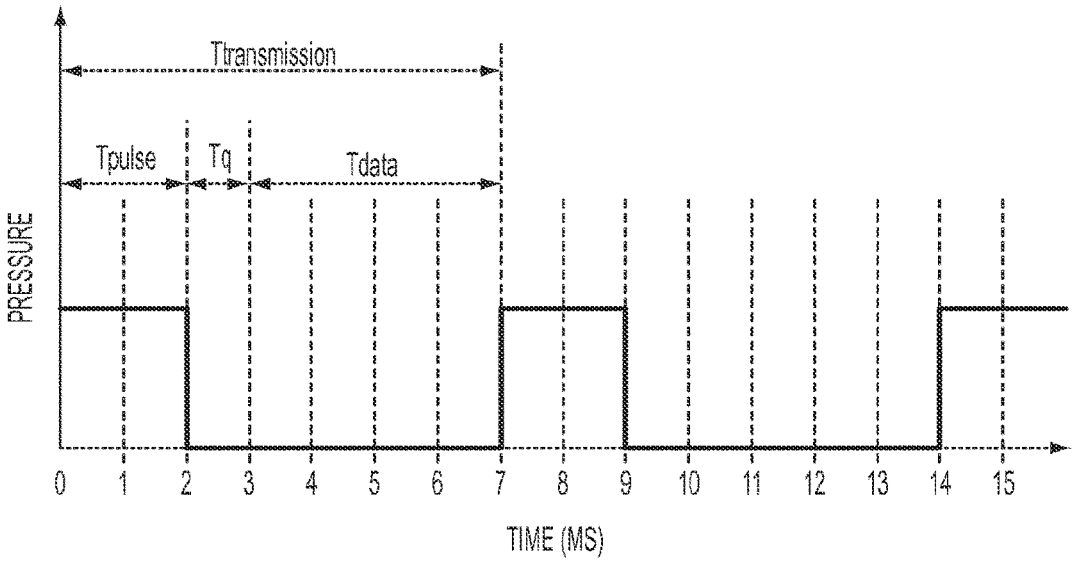
FIG. 3 is a graph showing a mud telemetry transmission according to one example.

FIG. 3 is a graph showing mud pulse telemetry transmissions according to one example. Traditionally, a mud pulse telemetry system can generate a pressure to transmit a bit (e.g., 1) to the surface well system. The telemetry system can generate another pressure transmit another bit (e.g., 0) to the surface. By modulating between the two pressures, the telemetry system can transmit data to the surface. It can be desirable, however, to increase the number of bits per transmission. This can increase the data throughput of the system. To increase the number of bits per transmission, the transmitter (e.g., the transmitter 106 of FIG. 2) can apply differential pulse position modulation (DPPM). DPPM can include encoding data in the time period ($T_{data}$) between pulses, as described below.

As shown in FIG. 3, each transmission ($T_{transmission}$) can include a pressure pulse for a minimum time period (T pulse). Each transmission can also include a rest time period ($T_q$). $T_q$ can include the minimum amount of time in which the transmitter must wait (e.g., in order to recharge a capacitor or other electronics for operating the valve) before it can operate the valve again. Each transmission can also include a time period associated with the data ($T_{data}$) to be transmitted. K bits of data (e.g., 2 bits) can be encoded in the width of $T_{data}$.

The total time period for each transmission can be represented by:

$$T_{transmission}=T_{pulse}+T_q+T_{data}.$$

In FIG. 7, the total time period is 7 ms. In other examples, the total time period can be faster or slower (e.g., each time interval can represent 10 ms, rather than 1 ms). Because the total time period for each transmission can depend on $T_{data}$ (which can depend on K), as K increases, the total time period for each transmission can correspondingly increase.

To further increase the number of bits per transmission, in some examples, the transmitter can also apply pulse width modulation (PWM) to the DPPM scheme. PWM can include encoding data in the width of $T_{pulse}$ by modulating the width of $T_{pulse}$. J bits of data (e.g., 2 bits) can be encoded in the width of $T_{pulse}$. By modulating the width of $T_{pulse}$, J bits can be encoded in the width of $T_{pulse}$ and K bits can be encoded in width of $T_{data}$. This can allow for J+K total bits to be communicated in each transmission. Each transmission can still include one pressure pulse, and $T_q$ can remain the same width.

A nomenclature can be developed to represent the waveform of each $T_{transmission}$ as binary numbers. For example, one amount of pressure can be represented as a 1, and another amount of pressure can be represented as a 0. Using this nomenclature, the first transmission ($T_{transmission}$) shown in FIG. 3 can be represented in binary as 1100000. The three most significant bits (e.g., 110) can represent the shape of the pulse. The 11 can represent the $T_{pulse}$ period and the 0 can represent the $T_q$ period. The four least significant bits (e.g., 0000) can represent the $T_{data}$ period. As another example, the second pulse can be represented in binary as 0000110. The four most significant bits (e.g., 0000) can represent the four data bits from the first pulse that precedes the second pulse. The three least significant bits (e.g., 110) can represent the shape of the second pulse, where 11 can represent the $T_{pulse}$ period and the 0 can represent the $T_q$ period.

In some examples, pressure reflections and noise (e.g., pump noise and noise from drill bit rotation) can distort the shape of the pressure pulse received at the surface of the well system. For example, noise can cause the width of the pressure pulse received at the surface of the well system to be different than the width of the pressure pulse output by the transmitter. This can cause the transmission to be mistaken for another transmission with a similar pressure pulse width, generating error. For example, a transmission including the number 4 can be decoded by a computing device at the well surface as including the number 5. In some examples, the transmitter may produce a wave shape that is not a square wave (e.g., a sine wave or triangle wave). This can help reduce the effects of noise on the transmission.

In some examples, the transmitter can apply Gray coding in combination with DPPM, PWM, or both DPPM and PWM. Gray coding can include mapping two similar transmission waveforms to binary numbers that differ by only one bit. Two transmission waveforms can be similar if their Euclidian distance (e.g., the integral of the square of their difference) is small. As another example, two transmission waveforms can be similar if they have similar $T_{transmission}$ widths and/or similar $T_{pulse}$ widths. For example, using the nomenclature described above, one transmission can be represented as 0000110. This transmission can have a $T_{transmission}$ of 7 ms and a $T_{pulse}$ of 2 ms. Another transmission can be represented as 0001110. This transmission can have a $T_{transmission}$ of 7 ms and a $T_{pulse}$ of 3 ms. These two transmissions can be similar because they both have a $T_{transmission}$ of 7 ms and close $T_{pulse}$ widths. To implement Gray coding, these two transmissions can be mapped to binary values that differ by 1 bit. For example, 0000110 can be mapped to the binary number 0000, and 0001110 can be mapped to the binary number 0001. The binary number 0000 differs from the binary number 0001 by only one bit. This can reduce the raw bit error rate, because if one transmission is distorted (e.g., due to noise) into a similar transmission, there is only 1 bit of error. Reducing the raw bit error rate can make it easier to apply forward error correction to correct the remaining errors.

FIG. 4 is a table showing transmission waveforms associated with Gray codes when $T_{pulse}$=3 ms, $T_q$=1 ms, J=2 bits, and K=2 bits according to one example. For transmissions with J+K bits of encoded data, there can be $2^{J+K}$ total possible transmission waveforms. The $2^{J+K}$ total possible waveforms can be grouped by total transmission length. For example, the $2^{J+K}$ total possible waveforms can be grouped from the shortest total transmission length to the longest total transmission length. An example of such a grouping is shown in the left column 402. The minimum total transmission length can be: $T_{pulse}+T_q$. For example, if $T_{pulse}$=3 ms, $T_q$=1 ms, J=2 bits, and K=2 bits, the shortest total transmission signal length can be 4. The maximum total transmission length can be: $T_{pulse}+T_q+2^K+2^J-2$. For example, if $T_{pulse}$=3 ms, $T_q$=1 ms, J=2 ms, and K=2 ms, the longest total transmission signal length can be 10 ms.

Each transmission waveform (e.g., in the left column 402) can be mapped (e.g., assigned) to a Gray coding value that differs by only one bit (e.g., as shown in the middle column 404). In some examples, each Gray coding value can be mapped to another value (e.g., a numerical value, letter, or word). For example, each Gray coding value can be mapped to a numerical value, as shown in the right column 406.

The table shown in FIG. 4 can represent an example of a lookup table usable by the transmitter and a computing device at the well surface. The transmitter can receive data (e.g., in the form of a numerical value or binary value) from a sensor. The transmitter can determine, based on the lookup table, a pressure waveform corresponding to the data. The transmitter can operate the valve to generate the pressure waveform, which can propagate through the fluid in the wellbore to the well surface. A transducer at the well surface can convert the pressure waveform into electrical signals and transmit the electrical signals to a computing device. The computing device can use the lookup table to determine the Gray code value and/or numerical value associated with the electrical signals. In this manner, the transmitter can communicate with a computing device at the well surface using the combined PWM, PPM, and Gray coding scheme. By combining the PPM, PWM, and Gray coding, the transmitter can transmit more data (e.g., there can be a higher data rate) with more reliability (e.g., due to a reduced raw bit error rate).

Figure 5:
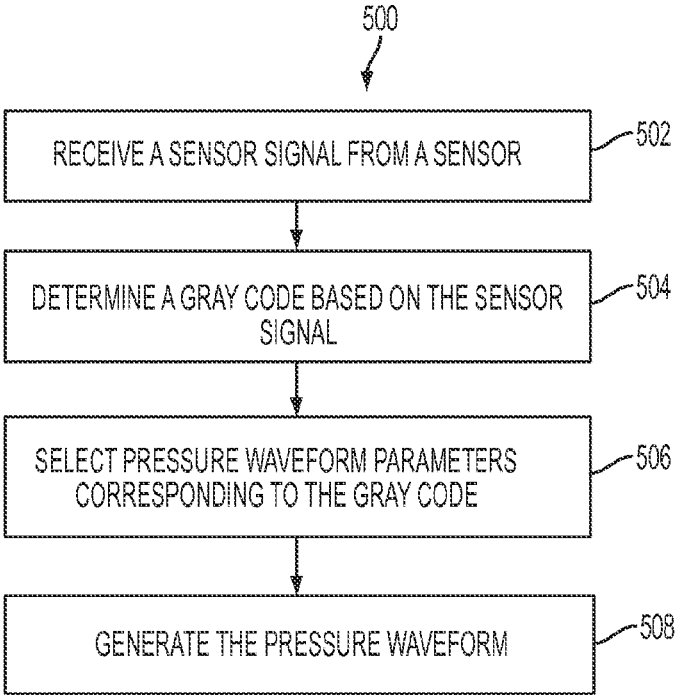
FIG. 5 is a flow chart showing an example of a process for implementing mud pulse telemetry using Gray coding according to one example.

FIG. 5 is a flow chart showing an example of a process 500 for implementing mud pulse telemetry using Gray coding according to one example. The process 500 below is described with reference to the components describe above with regard to transmitter 106 shown in FIG. 2.

In block 502, the transmitter 106 receives a sensor signal from a sensor 214. The sensor signal can be associated with a characteristic of a well tool (e.g., an orientation or position of a drill bit or drill string) or a wellbore. The sensor signal can include an analog signal or a digital signal.

In block 504, the transmitter 106 determines a Gray code based on the sensor signal. The transmitter 106 may consult a lookup table or apply an algorithm to determine the Gray code associated with the sensor signal. For example, the transmitter 106 can convert an analog sensor signal into a digital signal. The transmitter 106 can determine a Gray code corresponding to the digital signal using a lookup table.

In block 506, the transmitter 106 determines one or more pressure waveform parameters (e.g., parameters associated with a pressure waveform) corresponding to the Gray code. The transmitter 106 can consult a lookup table to determine the pressure waveform parameters based on the Gray code. The lookup table can map parameters of pressure waveforms to Gray codes and/or other data.

In some examples, the pressure waveform can include modulated pulse positions and modulated pulse widths (e.g., the width of $T_{pulse}$ from FIG. 3 can be modulated). Data can be encoded in the modulated pulse positions (e.g., using DPPM). Data can also be encoded in the modulated pulse widths (e.g., using PWM). In some examples, the pressure waveform can include multiple pressure pulses. Data can be encoded in the time difference (e.g., $T_{data}$ of FIG. 3) between the pressure pulses.

In block 508, the transmitter 106 generates the pressure waveform. The transmitter 106 can generate the pressure waveform by modulating a pressure of a fluid (e.g., a drilling fluid such as mud) in a well tool. For example, the transmitter 106 can operate the valve 216 to generate the pressure waveform in the fluid. The pressure waveform can propagate through the fluid to the surface of the well system.

In some aspects, a system for mud pulse telemetry using Gray coding is provided according to one or more of the following examples:

Example #1

A system can include a well tool operable to transmit a fluid through an interior of the well tool. The system can also include a transmitter coupled to the well tool. The transmitter can be operable to select a parameter of a pressure waveform using a Gray code that corresponds to the parameter and generate the pressure waveform in the fluid.

Example #2

The system of Example #1 may feature the pressure waveform including modulated pulse positions. Data can be encoded in the modulated pulse positions.

Example #3

The system of any of Examples #1-2 may feature a pressure waveform including modulated width positions. Data can be encoded in the modulated width positions.

Example #4

The system of any of Examples #1-3 may feature the parameter being mapped to the Gray code in a lookup table. The Gray code can include a binary value that differs by one binary digit from another binary value in an adjacent row of the lookup table.

Example #5

The system of any of Examples #1-4 may feature the pressure waveform including multiple pressure pulses. Data can be encoded in a time difference between the plurality of pressure pulses.

Example #6

The system of any of Examples #1-5 may feature a sensor operable to transmit a sensor signal associated with a characteristic of the well tool or a wellbore to the transmitter. The transmitter can be operable to determine the Gray code based on the sensor signal.

Example #7

The system of any of Examples #1-6 may feature the well tool including a logging while drilling tool or a measuring while drilling tool.

Example #8

A method can include selecting, by a transmitter, a parameter of a pressure waveform using a Gray code corresponding to the parameter. The method can also include generating, by the transmitter, the pressure waveform by modulating a pressure of a fluid in a well tool based on the parameter.

Example #9

The method of Example #8 may feature the pressure waveform including modulated pulse positions. Data can be encoded in the modulated pulse positions.

Example #10

The method of any of Examples #8-9 may feature the pressure waveform including modulated pulse widths. Data can be encoded in the modulated pulse widths.

Example #11

The method of any of Examples #8-10 may feature the pressure waveform including multiple pressure pulses. Data can be encoded in a time difference between the plurality of pressure pulses.

Example #12

The method of any of Examples #8-11 may feature receiving a sensor signal from a sensor. The sensor signal can be associated with a characteristic of the well tool or a wellbore to the transmitter. The method may also feature determining the Gray code based on the sensor signal.

Example #13

The method of any of Examples #8-12 may feature the well tool including a logging while drilling tool or a measuring while drilling tool.

Example #14

The method of any of Examples #8-13 may feature the parameter being mapped to the Gray code in a lookup table. The Gray code can include a binary value that differs by one binary digit from another binary value in an adjacent row of the lookup table.

Example #15

A telemetry transmitter can include a processor. The telemetry transmitter can also include a memory in which instructions executable by the processor are stored. The instructions can cause the processor to select a parameter of a pressure waveform using a Gray code that corresponds to the parameter. The instructions can also cause the processor to operate a valve based on the parameter to generate the pressure waveform in a fluid in a well tool.

Example #16

The telemetry transmitter of Example #15 may feature the pressure waveform including modulated pulse positions. Data can be encoded in the modulated pulse positions.

Example #17

The telemetry transmitter of any of Examples #15-16 may feature the pressure waveform including modulated pulse widths. Data can be encoded in the modulated pulse widths.

Example #18

The telemetry transmitter of any of Examples #15-17 may feature the parameter being mapped to the Gray code in a lookup table. The Gray code can include a binary value that differs by one binary digit from another binary value in an adjacent row of the lookup table.

Example #19

The telemetry transmitter of any of Examples #15-18 may feature a sensor operable to transmit a sensor signal associated with a characteristic of the well tool or a wellbore to the processor. The memory can further include instructions executable by the processor for causing the processor to determine the Gray code based on the sensor signal.

Example #20

The telemetry transmitter of any of Examples #15-19 may feature the well tool including a logging while drilling tool or a measuring while drilling tool.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a well tool operable to transmit a fluid through an interior of the well tool; and a transmitter coupled to the well tool and operable to:

determine a value to transmit;

determine a Gray code representing the value;

select a transmission waveform corresponding to the Gray code using a predefined lookup table, wherein the predefined lookup table includes relationships between (i) a plurality of Gray code values and (ii) a plurality of different transmission waveforms for pressure waves; and generate a pressure wave having the transmission waveform in the fluid.

2. The system of claim 1, wherein the pressure wave comprises modulated pulse positions, and wherein data is encoded in the modulated pulse positions.

3. The system of claim 2, wherein the pressure wave comprises modulated pulse widths, and wherein data is encoded in the modulated pulse widths.

4. The system of claim 1, wherein the Gray code comprises a binary value that differs by one binary digit from another binary value in an adjacent row of the predefined lookup table.

5. The system of claim 1, wherein the pressure wave comprises a plurality of pressure pulses, and wherein data is encoded in a time difference between the plurality of pressure pulses.

6. The system of claim 1, further comprising:

a sensor operable to transmit a sensor signal associated with a characteristic of the well tool or a wellbore to the transmitter, wherein the transmitter is operable to determine the value to transmit based on the sensor signal.

7. The system of claim 1, wherein the well tool comprises a logging while drilling tool or a measuring while drilling tool.

8. A method comprising:

determining, by a transmitter, a value to transmit;

determining, by the transmitter, a Gray code representing the value;

selecting, by the transmitter, a transmission waveform corresponding to the Gray code using a predefined lookup table, wherein the predefined lookup table includes relationships between (i) a plurality of Gray code values and (ii) a plurality of different transmission waveforms for pressure waves; and generating, by the transmitter, a pressure wave having the transmission waveform by modulating a pressure of a fluid in a well tool.

9. The method of claim 8, wherein the pressure wave comprises modulated pulse positions, and wherein data is encoded in the modulated pulse positions.

10. The method of claim 9, wherein the pressure wave comprises modulated pulse widths, and wherein data is encoded in the modulated pulse widths.

11. The method of claim 8, wherein the pressure wave-comprises a plurality of pressure pulses, and wherein data is encoded in a time difference between the plurality of pressure pulses.

12. The method of claim 8, further comprising:

receiving a sensor signal from a sensor, the sensor signal associated with a characteristic of the well tool or a wellbore; and determining the value to transmit based on the sensor signal.

13. The method of claim 8, wherein the well tool comprises a logging while drilling tool or a measuring while drilling tool.

14. The method of claim 8, wherein the Gray code comprises a binary value that differs by one binary digit from another binary value in an adjacent row of the predefined lookup table.

15. A telemetry transmitter comprising:

a processor; and a memory in which instructions executable by the processor are stored for causing the processor to:

determine a Gray code;

select a transmission waveform corresponding to the Gray code using a predefined lookup table, wherein the predefined lookup table includes relationships between (i) a plurality of Gray code values and (ii) a plurality of different transmission waveforms for pressure waves; and operate a valve to generate a pressure wave having the transmission waveform in a fluid in a well tool.

16. The telemetry transmitter of claim 15, wherein the pressure wave comprises modulated pulse positions, and wherein data is encoded in the modulated pulse positions.

17. The telemetry transmitter of claim 16, wherein the pressure wave comprises modulated pulse widths, and wherein data is encoded in the modulated pulse widths.

18. The telemetry transmitter of claim 15, wherein the Gray code comprises a binary value that differs by one binary digit from another binary value in an adjacent row of the predefined lookup table.

19. The telemetry transmitter of claim 15, further comprising a sensor operable to transmit a sensor signal associated with a characteristic of the well tool or a wellbore to the processor, wherein the memory further comprises instructions executable by the processor for causing the processor to determine the Gray code based on the sensor signal.

20. The telemetry transmitter of claim 15, wherein the well tool comprises a logging while drilling tool or a measuring while drilling tool.

21. The system of claim 1, wherein the predefined lookup table further includes a relationship between the Gray code and the value.

22. The system of claim 21, wherein the transmitter is operable to select the transmission waveform by:

determining that the value is to be expressed by the pressure wave;

determining the Gray code based on the relationship between the value and the Gray code in the predefined lookup table; and determining the transmission waveform based on another relationship between the Gray code and the transmission waveform in the predefined lookup table.

23. The system of claim 1, wherein the predefined lookup table includes a plurality of rows, each row of the plurality of rows including (i) a respective transmission waveform, (ii) a respective Gray code corresponding to the respective transmission waveform, and (iii) a respective value corresponding to the respective Gray code.

24. The system of claim 23, wherein the plurality of rows are organized in the predefined lookup table such that each adjacent row has a respective Gray code with a single bit that is different from at least one of (i) a prior Gray code in a prior row, or (ii) a subsequent Gray code in a subsequent row.

* * * * *